US005931227A

United States Patent [19]

Graves

[11] Patent Number: 5,931,227

[45] Date of Patent: Aug. 3, 1999

[54] CONVERSION OF CONSTANT VOLUME HEATING/AIR CONDITIONING SYSTEMS

[75] Inventor: James R. Graves, Houston, Tex.

[73] Assignee: Graco Mechanical, Inc., Houston, Tex.

[21] Appl. No.: 08/977,164

[22] Filed: Nov. 24, 1997

[51] Int. Cl.[6] ..... F24F 3/00; F24F 7/00

[52] U.S. Cl. ..... 165/216; 165/217; 236/49.3; 454/256

[58] Field of Search ..... 165/216, 217; 236/49.3; 454/256, 258

[56] References Cited

U.S. PATENT DOCUMENTS

| | | | |
|---|---|---|---|
| 4,099,553 | 7/1978 | Burnham et al. | 165/217 X |
| 4,630,670 | 12/1986 | Wellman et al. | 165/216 |
| 4,635,445 | 1/1987 | Otsuka et al. | 165/217 X |
| 4,821,526 | 4/1989 | Otsuka et al. | 165/217 X |
| 4,886,110 | 12/1989 | Jackson | 165/217 |
| 4,995,307 | 2/1991 | Floud | 454/256 X |
| 5,251,815 | 10/1993 | Foye | 454/256 X |
| 5,344,069 | 9/1994 | Narikiyo | 165/217 X |
| 5,385,031 | 1/1995 | Kizawa et al. | 454/256 X |
| 5,540,619 | 7/1996 | Ahmed | 454/256 |
| 5,564,626 | 10/1996 | Kettler et al. | 236/49.3 |
| 5,590,830 | 1/1997 | Kettler et al. | 236/49.3 |
| 5,705,734 | 1/1998 | Ahmed | 454/256 X |

*Primary Examiner*—Ira S. Lazarus
*Assistant Examiner*—Lance Chandler
*Attorney, Agent, or Firm*—Bracewell & Patterson, L.L.P.

[57] ABSTRACT

Constant volume multizone heating/air conditioning systems are converted to variable volume air conditioning systems. Energy conservation is achieved by converting the fan drive from one requiring constant volume air flow. Instead, the volume of air flow is governed by relative heating or cooling needs. Further, mixture of heated and cooled air to achieve the desired temperature is no longer required. Temperature sensors in a zone being heated/cooled detect actual temperature there. When the actual temperature indicates a need for cooling, the vent vanes of the system are opened and the heating vent vanes are closed. The fan speed and volume of air flow are then controlled to provide the required amounts of cooled air. Conversely, when heating is sensed to be needed, the heating and cooling air vent vanes positions are reversed and the fan speed regulated to supply the requisite amount of heated air.

20 Claims, 11 Drawing Sheets

CONVERSION OF CONSTANT VOLUME HEATING/AIR CONDITIONING SYSTEMS

BACKGROUND OF THE INVENTION

1. Field of the Invention

The present invention relates to converting constant volume heating/air conditioning systems to reduce energy consumption.

2. Description of the Related Art

Multizone air conditioning/heating units have been used extensively in buildings and other spaces for occupant comfort, as well as for process temperature and humidity control. Beginning in the late 1940's, these units were widely placed into service.

With multizone units, several different zones (usually from two to twelve or so) were supplied with air from a centrally located air handling unit. The air handling unit typically had both heating and cooling sections, each of which acted on a portion of the circulating air. Based on the temperature sensed in a particular zone, the required air mixture of heated and cooled air was furnished. Mixing of the heated air and the cooled air was accomplished by regulating the amount of air flow through controllable position flow regulating vents. Multizone units were required by their design to transport a constant volume of air continuously during unit operation. That constant volume was designed to meet peak or worst conditions of the hottest and coldest days of the year. Those conditions occurred less than about five percent of the time. The fans in multizone units were required, though, to produce constant volumes of air based on these worst case conditions. Less than peak loads were met by regulating the mixture of heated and cooled air to achieve the desired temperature, based on sensed temperatures in the various zones.

For a considerable time, multizone and double duct constant volume units were almost exclusively the only type installed. The constant volume for production demanded considerable energy usage. This was not considered a problem so long as inexpensive energy was available. However, in the last twenty or so years, energy costs have risen considerably. Removal and replacement of installed multizone units by variable volume units was a possible technique of energy conservation, but this was available only at a considerable cost. As a result, there are a large number of high energy usage, constant air volume multizone heating/air conditioning units still in service.

SUMMARY OF THE INVENTION

Briefly, the present invention provides a new and improved air handling (heating/air conditioning) system with reduced energy consumption. The system is made by converting an existing air treating system of the type with a constant volume fan. The existing air treating system converted may be a unit of the conventional multizone type, or the bypass multizone type or a double duct unit. Whatever type of existing air treating system is converted, a new and improved air conditioning/heating system results with the present invention. The resulting system is achieved by installing a control system according to the present invention.

With the control system of the present invention, a thermostat detects air conditions in a zone. An air treating unit imparts required characteristics (heating or cooling) to air being moved by a fan based on conditions sensed by the thermostat. An air flow regulator or variable air volume unit controls the volume of moving air, again based on conditions sensed by the thermostat. Pressure of the air being moved by the fan is sensed at the air treating unit, and a fan speed controller adjusts the fan speed by reducing it as air pressure in the treating unit increases. The sensed air pressure increases as the air flow regulator reduces the air flow in response to lower need for heated or cooled air. Thus, fan speed is reduced according to reduced need for air flow, reducing power consumption by the fan and saving energy.

DETAILED DESCRIPTION OF THE PREFERRED EMBODIMENT

Figure 1:
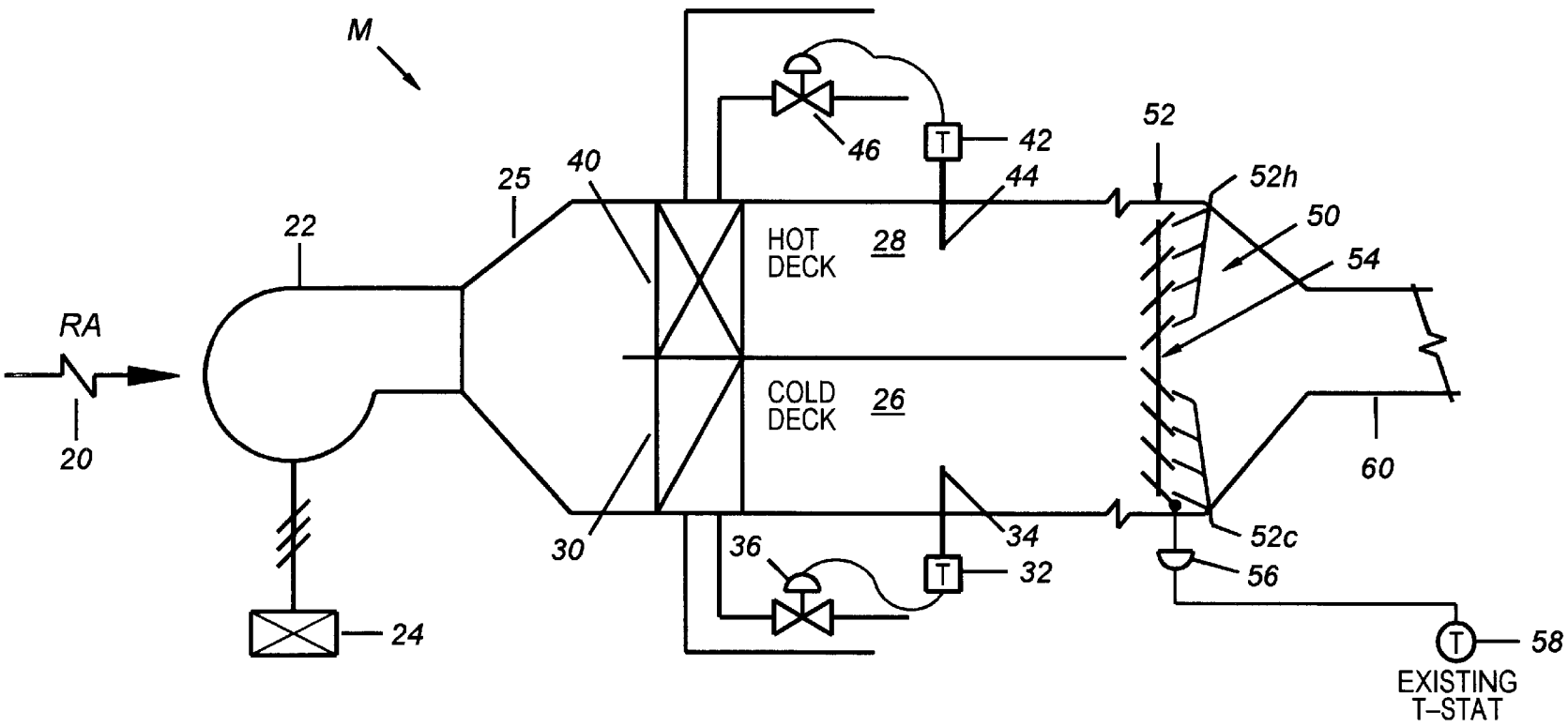
FIG. 1 is a schematic diagram of a prior art multizone unit.

At the outset, a brief explanation of prior art constant volume heating/air conditioning or air handling systems is given for the purposes of a more detailed background. In FIG. 1 of the drawings, a typical prior art standard multizone air handling unit M is shown. The multi-zone unit M receives return air after suitable air filtration, as indicated at 20, which is provided to a constant volume fan 22. The constant volume fan 22 after activation by a starter 24 causes the return air to pass into a plenum 25 where air flow is divided into substantially equal portions. A first portion of the air flow from the fan 22 passes into a cold deck 26, while the other portion of the air goes into a hot deck 28.

In the cold deck 26, a cooling coil 30 cools air flowing through it. The cooling coil may be of any conventional type, such as a chilled water unit, or a direct expansion type, or other suitable type to provide the required amount of cooling. A thermostat 32 with a sensing bulb 34 is provided in the flow of air downstream from the cooling coil 30 to sense air temperature. Thermostat 32 provides signals, typically pneumatic, to a control system, shown schematically as a pneumatically controlled valve 36, to cause the cooling coil 30 to impart the required amount of cooling to the air flowing through it.

In the hot deck 28, a heating coil 40 heats air flowing through it. The heating coil 40 may be of the type driven by steam, hot water, electric heat or other suitable heat source to provide the required heating. A thermostat 42 with a sensing bulb 44 is provided in the flow of air downstream from the heating coil 40 to sense air temperature. The thermostat 42 provides control signals, usually pneumatic, to a control system, shown schematically as a pneumatically controlled valve 46, to cause the heating coil 40 to impart the required amount of heat to the air passing through it.

The emerging heated air stream from the hot deck 28 and cooled air stream from the cold deck 26 are passed to a damper section 50. In the damper section 50, for each zone of the multizone unit M being served a set of vanes as shown at 52 are provided. The vane set 52 for a particular zone is mounted on a common activator or actuator shaft 54 located in the flow path across air streams from the hot deck 28 and the cold deck 26. The vanes 52 serve to mix or blend the volume of air to maintain the desired temperature for that particular zone. The vanes 52 for each zone include a suitable number of heat zone flow regulating vanes 52*h* and a suitable number of cold zone flow regulating vanes 52*c*. The vanes 52*h* and 52*c* for a particular zone mounted on the common shaft 54 undergo concurrent movement in opposite directions as the shaft 54 is moved.

The relative movement of each shaft 54 is controlled by a damper motor 56. Damper motor 56 is in turn controlled by a signal from a thermostat 58 in a zone associated with that particular set of vanes 52. The mixture or blending of air is determined by the relative degree of opening and closing of the associated vanes 52*h* and vanes 52*c* for that zone. As the amount of heating required increases, the relative position of the vanes 52*h* and 52*c* is adjusted, due to movement of the shaft 54 by damper motor 56, to increase the amount of air permitted to flow through the heat zone vanes 52*h*. Concurrently the movement of cooled air from the cold deck 26 is inhibited by corresponding movement of the cold zone vanes 52*c* to a more relatively closed position. When more cooling is required, flow of air through vanes 52*c* is increased by movement of shaft 54, with consequent reduction of air flow through vanes 52*c*.

The mixed or blended air is conveyed from the vane set 52 of each damper section 50 by ducts, one of which is indicated schematically at 60. The number of separate zones available on a multi-zone unit is determined by the physical size of the unit. Typically from two to twelve zones are supplied by a single multi-zone unit M. Thus, a set of from two to twelve sets of vanes are normally present, one for each zone having a thermostat 58.

Figure 2:
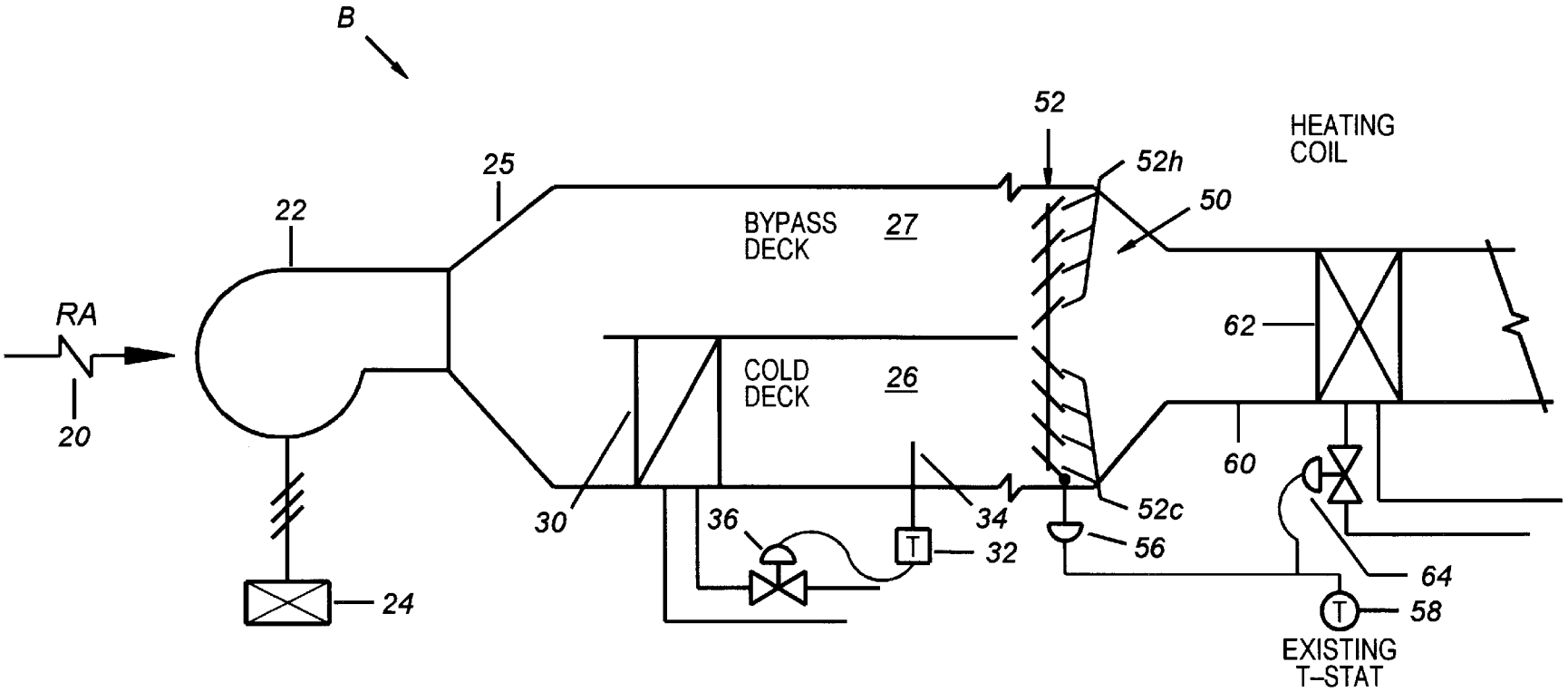
FIG. 2 is a schematic diagram of a prior art bypass multizone unit, also known as a Texas multizone unit.

In FIG. 2, a typical prior art bypass multizone unit B is shown. The bypass multizone unit B is a variation of the standard multizone unit M of FIG. 1. Thus, structure of like construction and operating in a like manner to that of FIG. 1 bears like reference numerals. In the bypass multi-zone unit B (FIG. 2), a bypass deck 27 to pass return air at its return temperature is provided. The bypass unit B has no heat deck, since bypass deck 22 is provided in place of the heat deck 28 present in a standard multi-zone unit M (FIG. 1). Usually some sort of air flow restrictor is provided in the bypass deck 27 to cause an air pressure loss to occur in the bypass deck 27 comparable to that occurring in the cold deck 26. This is done to maintain a relatively constant air flow while blending air streams at vanes 52. Heating for the bypass multizone unit, which is also known as a Texas multi-zone unit, is provided by a separate set of heating devices 62, located in each of the ducts 60. The heating devices 62 may be driven by steam, hot water, electrical heat or other suitable heat source. A control system indicated schematically by a valve 64 regulated by the thermostat 58 controls the amount of heating imparted to the air downstream from the vanes 52.

Figure 3:
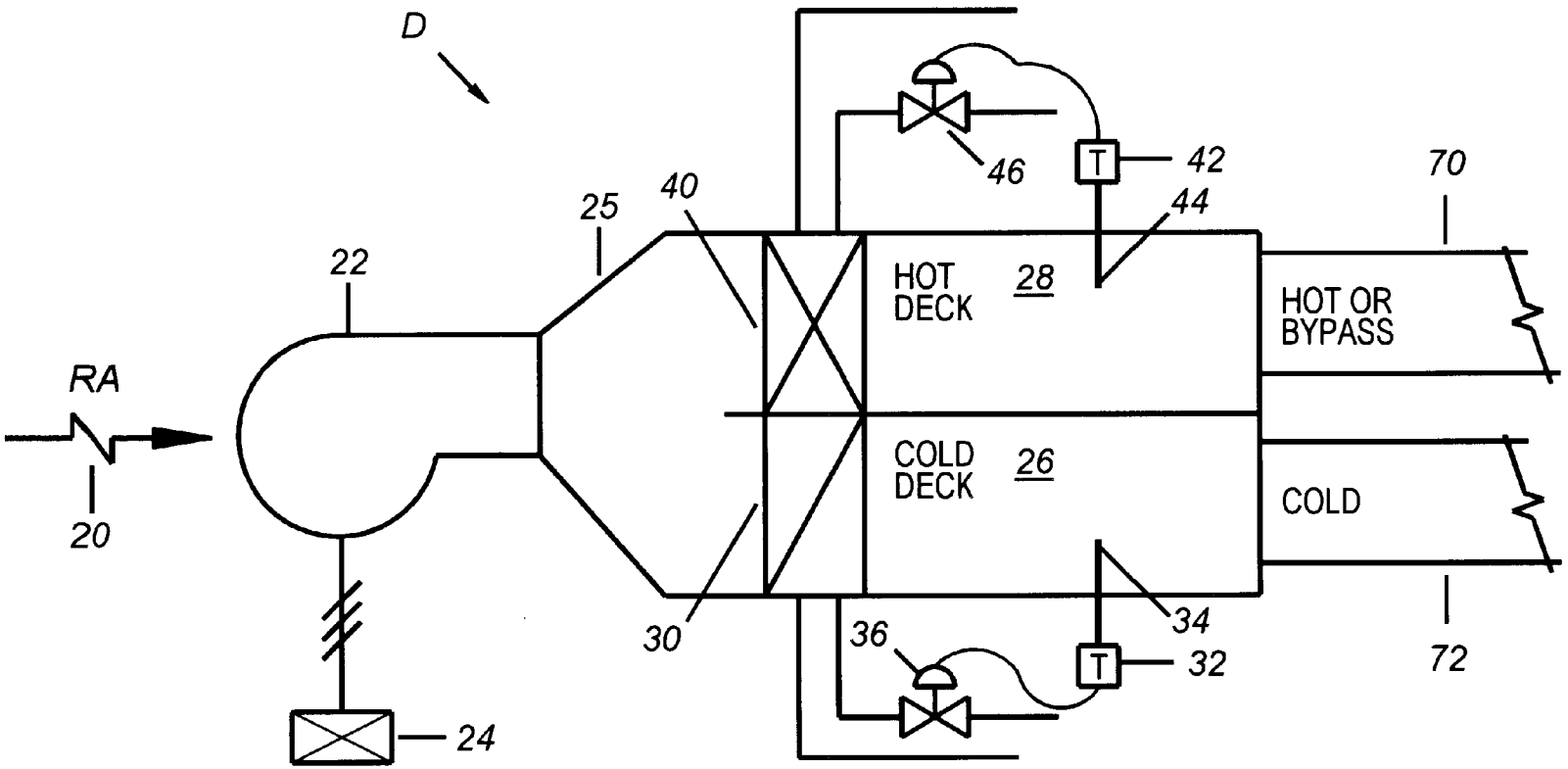
FIG. 3 is a schematic diagram of a prior art duct (also called dual duct) unit.

In FIG. 3, a typical prior art double duct system D is shown. The double duct system D has a number of common elements to that of the standard multi-zone unit M, and accordingly structure of like construction and operating in a like manner to that of FIG. 1 bears like reference numerals. In the double duct system D, the heated air from the hot deck 28 passes into a hot air duct system 70. Similarly, the cooled air from the cold deck 26 passes through a cold air duct 72. The hot duct 70 and cold duct 72 extend from the main unit or plenum 25 to each of the individual zones. In each of the individual zones, an individual terminal blending unit U is located, typically near the space being served.

Figure 4:
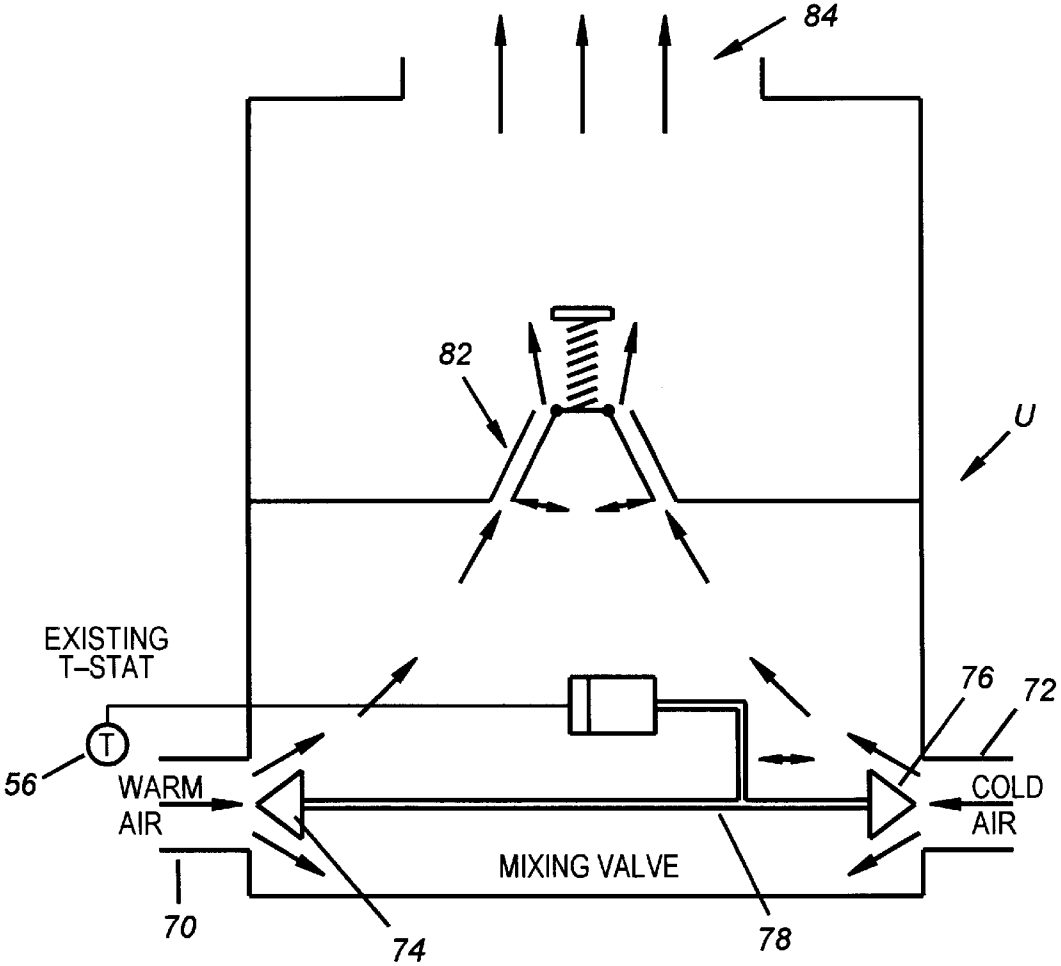
FIG. 4 is a schematic diagram of a double duct mixing box used with the unit of FIG. 1.

At each such location a double duct mixing box U (FIG. 4) is located. The mixing box U receives warm air at an inlet from duct 70 and cold air an inlet from duct 72. A flow regulating valve having a commonly actuated warm air flow damper 74 and cold air flow damper 76 on a common shaft 78 is selectively positioned to control the relative flows of warm air from the warm air duct 70 and cold air from the cold air duct 72 into a mixing zone 80. The relative amounts of warm air and cold air flowing into the mixing zone 80 as indicated schematically by arrows is controlled by a damper motor 81. Damper motor 81 operates under control of temperature conditions sensed by the thermostat 58. The incoming warm and cold air passes from the mixing zone 80 through a volume control device shown schematically at 82, and therefrom through an outlet 84 into the zone being served by that particular mixing box U.

Figure 5:
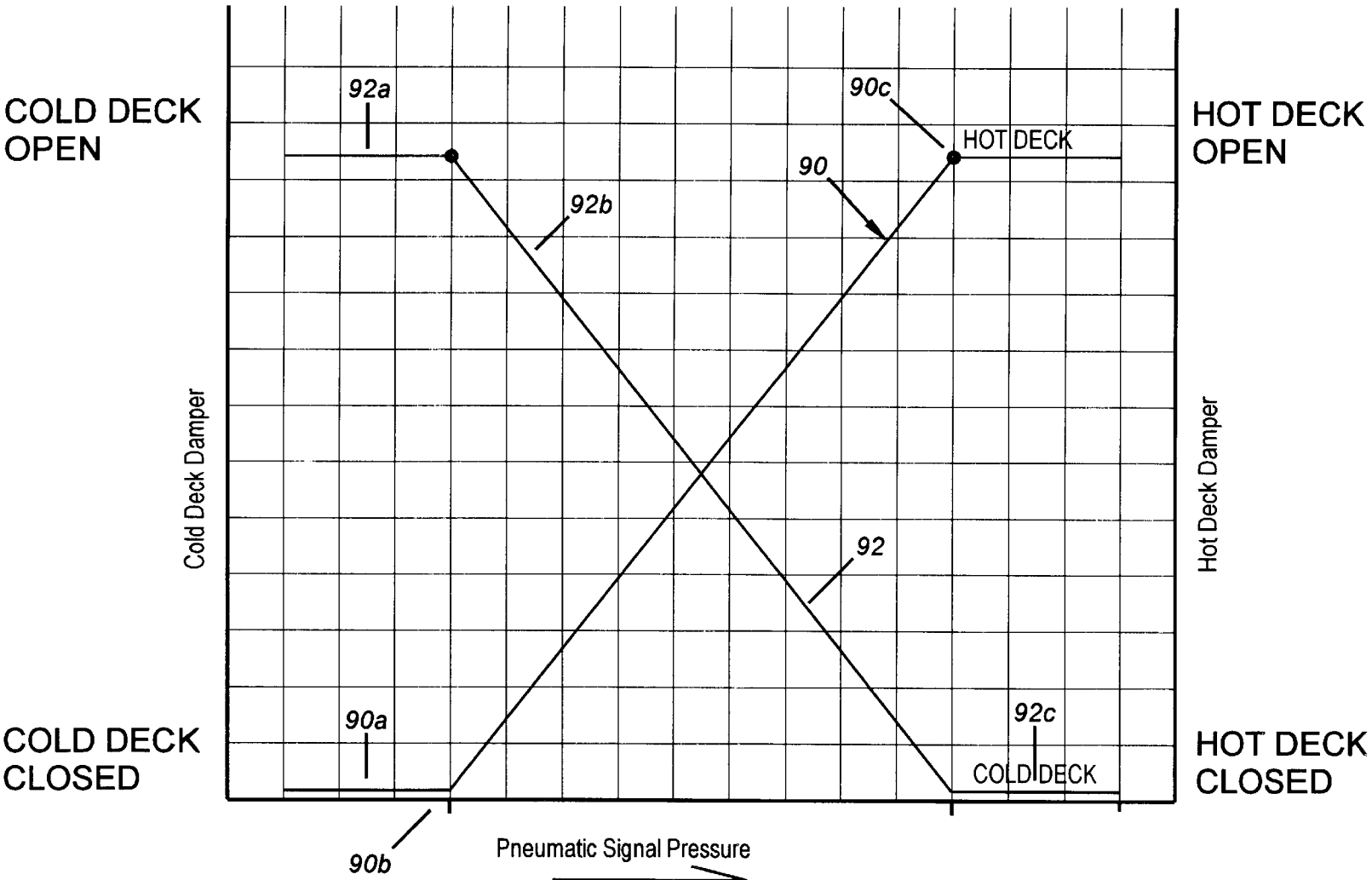
FIG. 5 is a diagram of thermostat pneumatic pressure versus flow control damper position relating to prior art systems of FIGS. 1 through 4.

In FIG. 5 of the drawings, a schematic diagram of common operating characteristics of the prior art constant volume air handling or heating/air conditioning units of FIGS. 1 through 4 is shown. As indicated by a performance characteristic line 90, the hot deck damper function, whether performed by the vanes 52 (FIGS. 1 & 2) or by the hot zone damper 74 (FIG. 4) of the mixing box U, is in a fully closed position as indicated at 90*a* at low signal pressures from the thermostat 56. At a certain transition temperature, the performance of the hot zone damper, as indicated at region 90*b* of FIG. 5, begins to gradually allow increasing amounts of heated air to flow through the hot zone damper until a pneumatic signal pressure is reached, as indicated at 90*c*, at which point the hot zone or hot deck damper becomes fully open.

Conversely, as indicated by a performance line or characteristic 92, the cold deck or zone damper at signal pressures from the thermostat 58 corresponding to closed hot deck vanes 52*h* or damper 74 begins in a fully opened position as indicated at a region 92*a*. This continues until a transition temperature established at thermostat 58 is reached. At this point, as indicated by performance characteristic line 92*b*, the cold deck damper, whether the vanes 52 (FIGS. I & 2) or the cold deck damper 76 of the mixing box U (FIG. 4), begins gradually to increasingly close and restrict flow of cold air in response to changing signal pressure from the thermostat 58. This continues to restrict the flow of cold air until a transition signal pressure or temperature sensed by the thermostat 58 is reached, as indicated at region 92*c*, at which point the cold deck damper is fully closed so that no cold air is allowed to flow through the vanes 52 or 52*c* the mixing box U. The region 92*c* with cold air flow blocked corresponds to the region 90*c* with hot air flow fully open.

THE PRESENT INVENTION

Figure 6:
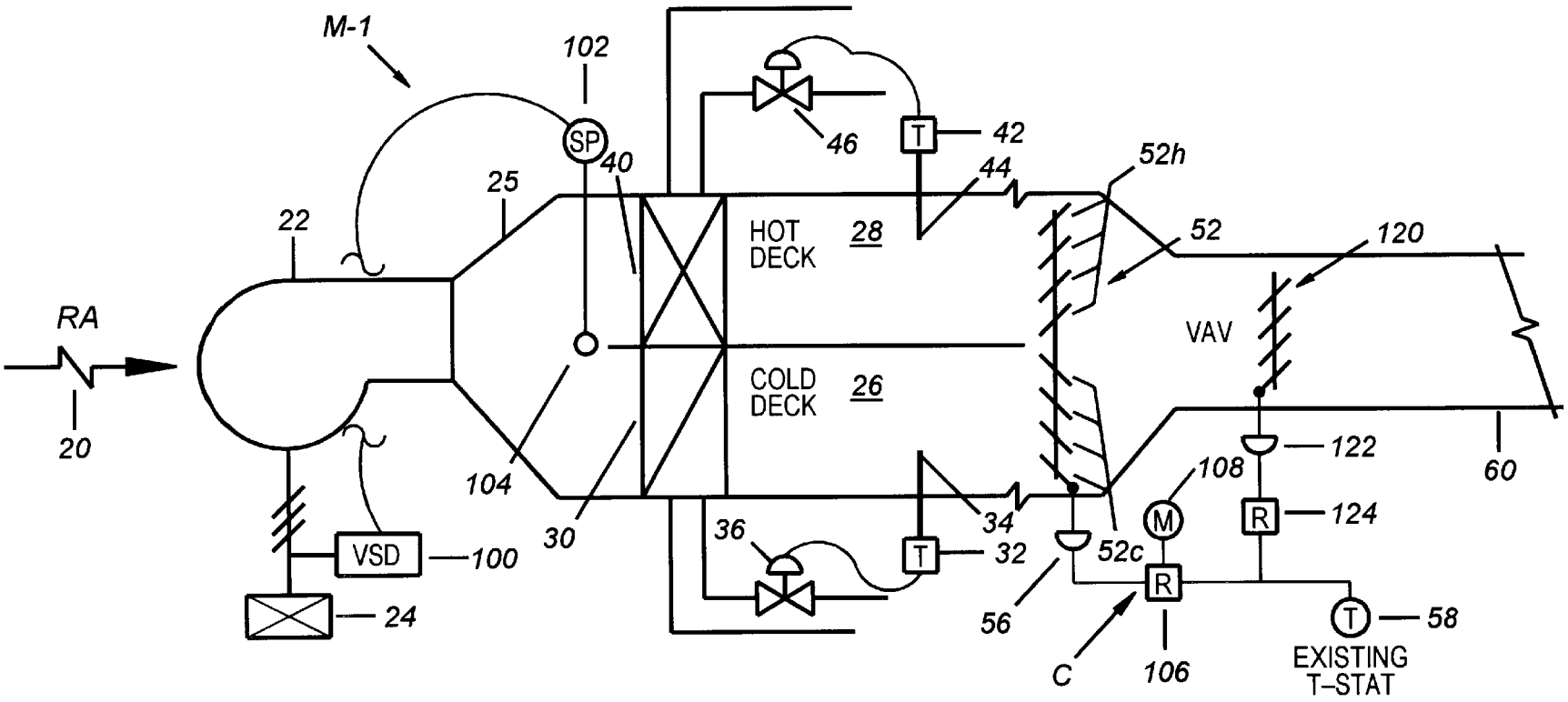
FIG. 6 is a schematic diagram of a multizone unit after conversion to a variable volume unit according to the present invention.

Turning to FIG. 6 of the drawings, a multizone air conditioning unit M-1 in accordance with the present invention after having been modified with a control system C of the present invention is shown. The multizone unit M-1 is a modified or converted system resulting from modification of the system M of FIG. 1. Accordingly, structure of the unit M-1 performing in a like manner to that of the unit M of FIG. 1 bears like reference numerals.

The fan 22 of the multizone unit M-1 is driven by a variable speed drive 100. The variable speed drive 100 is connected to a static pressure sensor 102 which is connected at an inlet port 104 to sense static air pressure conditions in the plenum 25 of air leaving the fan 22. As static pressure is sensed by the sensor 102 at inlet 104 increases, the variable speed drive 100 causes the speed of operation of the fan 22 to decrease. In a corresponding manner, as static pressure sensed by the sensor 102 decreases, the variable speed drive 100 causes the speed of operation of the fan 22 to increase.

The thermostat 58 of the multizone unit M-1 is connected through a relay 106 receiving power from a pneumatic main 108 to the damper motor 56 controlling position of the vanes 52. A suitable type of relay 106 is a snap-acting or two position relay, such as a model RP-471A from Honeywell, Inc., although it should be understood that other types might also be used.

Figure 9:
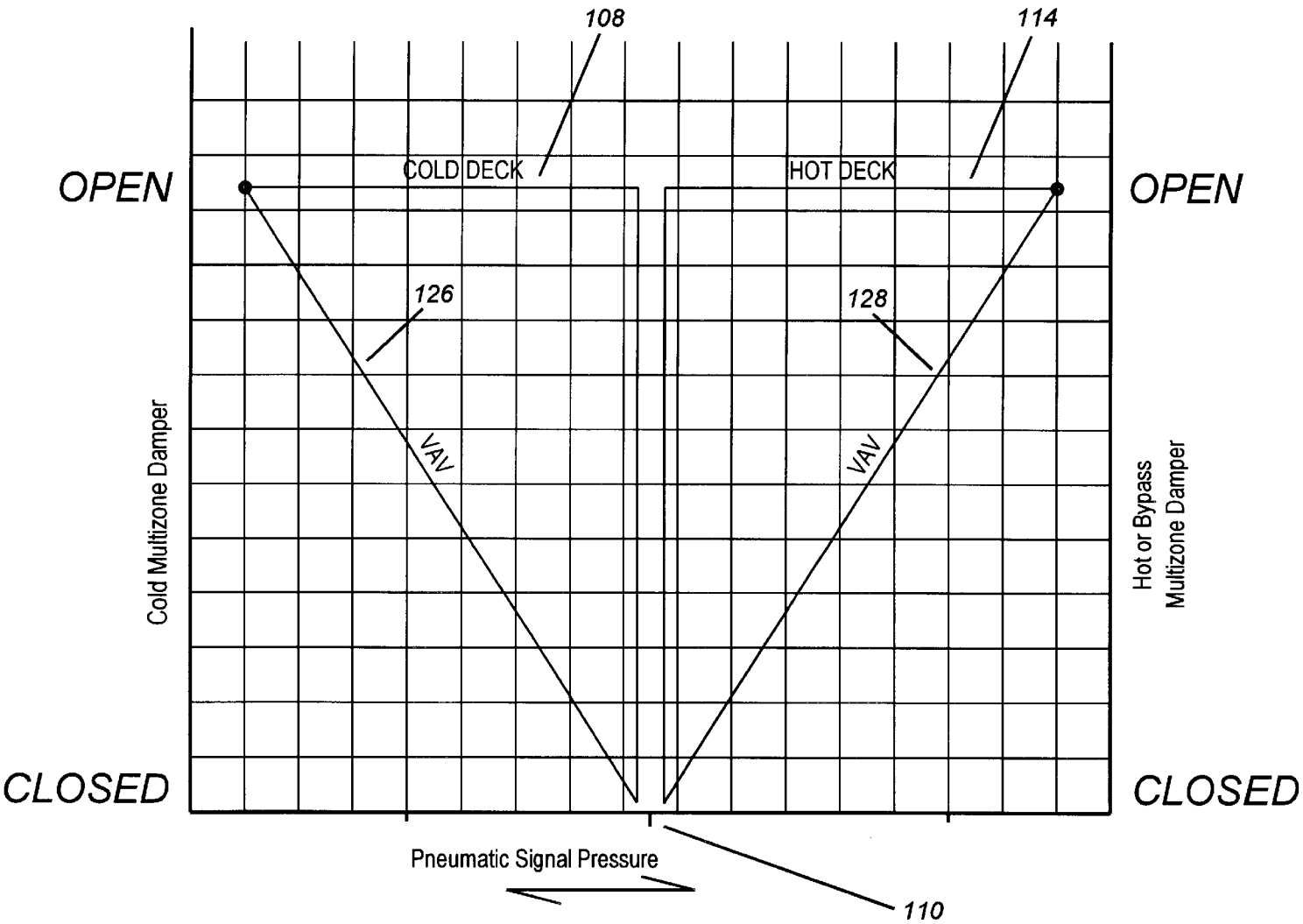
FIG. 9 is a diagram of thermostat pneumatic pressure versus flow control damper position illustrative of the operation of the systems shown in FIGS. 6 through 8.

As will be set forth, the relay 106 causes the vanes 52*h* and 52*c* to assume either of two mutually exclusive positions. These two positions depend on the temperature sensed by the thermostat 58. As indicated in FIG. 9, when the temperature sensed by the thermostat 58 is above an established threshold temperature as indicated at 110, the relay 106 causes the cool zone vanes 52*c* to be fully open, as indicated by a performance curve 108 and the hot zone vanes 52*h* to be fully closed. Conversely, when the temperature sensed by the thermostat 58 is less than the established threshold 110, the relay 106 causes the vanes 52*c* and 52*h* to reverse positions. Thus, the heat zone vanes 52*h* are fully open as indicated by performance curve 114 and the cold zone vanes 52*c* are fully closed when the thermostat 58 senses temperature conditions above the threshold temperature indicated at 110.

A set of variable air volume or flow regulating vanes 120 (FIG. 6) are located in each duct 60 of the multizone unit M-1. The vanes 120 control the volume of air moving in duct 60 based on temperature conditions sensed by the thermostat 58. The position of the vanes 120 is set by a damper motor 122 driven by a reversing relay or control 124. The reversing relay is, for example, of the type sold as model RRC 1504 by Krueter Manufacturing Corporation, although other types may also be used for this purpose. The reversing relay 124 is driven by a signal from the thermostat 58 indicative of temperature in the zone being serviced.

As the thermostat 58 indicates either increased heating or increased cooling is needed, the reversing relay 124 and the damper motor 122 allow increasing volumes of air to flow from the multizone unit M-1 through the ductwork 60. Similarly, when the thermostat 58 indicates reduced cooling or heating is needed, the reversing relay 124 and damper motor 122 reduce the volume of air permitted to flow from the unit M-1 through the duct 60.

As the vanes 120 move to a more closed position in response to the damper motor 122, the static pressure sensed at the inlet port 104 by sensor 102 increases.

As can be seen in FIG. 9, the variable air volume or flow regulating unit 120, as indicated by performance curve 126, reduces the static pressure and allows increasing volumes of cooled air to flow through open vanes 52*c* as the thermostat 58 senses the need for increased cooling. As noted above, the control or relay 106 causes vanes 52*h* to be closed when vanes 52*c* are open. Similarly, when thermostat 58 senses that increased heating is required, the flow regulating variable air volume vane unit 120 reduces static pressure, as indicated at 128, while increasing the volume of air permitted to pass through duct 60 from open heat vanes 52*h*. Again, when the vanes 52*h* are opened, the vanes 52*c* are closed by relay 106.

As has been set forth above, this in turn causes the variable speed drive 100 to reduce the speed of the fan 22. Thus, with the present invention, when the thermostat 58 senses reduced need for more heating or cooling in the zone being serviced, the flow regulating vanes 120 are adjusted in position, which in turn reduces the operating speed of the fan 22. The speed of operation of the fan 22 is related to the power consumed by that fan in a third power or cube relation. That is, increases in fan speed cause power consumption by that fan to increase according to the cube or third power of the increase. Thus, with the present invention, it can be seen that the control system incorporated in the multizone unit M-1 causes significant reductions in power consumption by the fan 22 which formerly operated as a constant volume fan.

Figure 7:
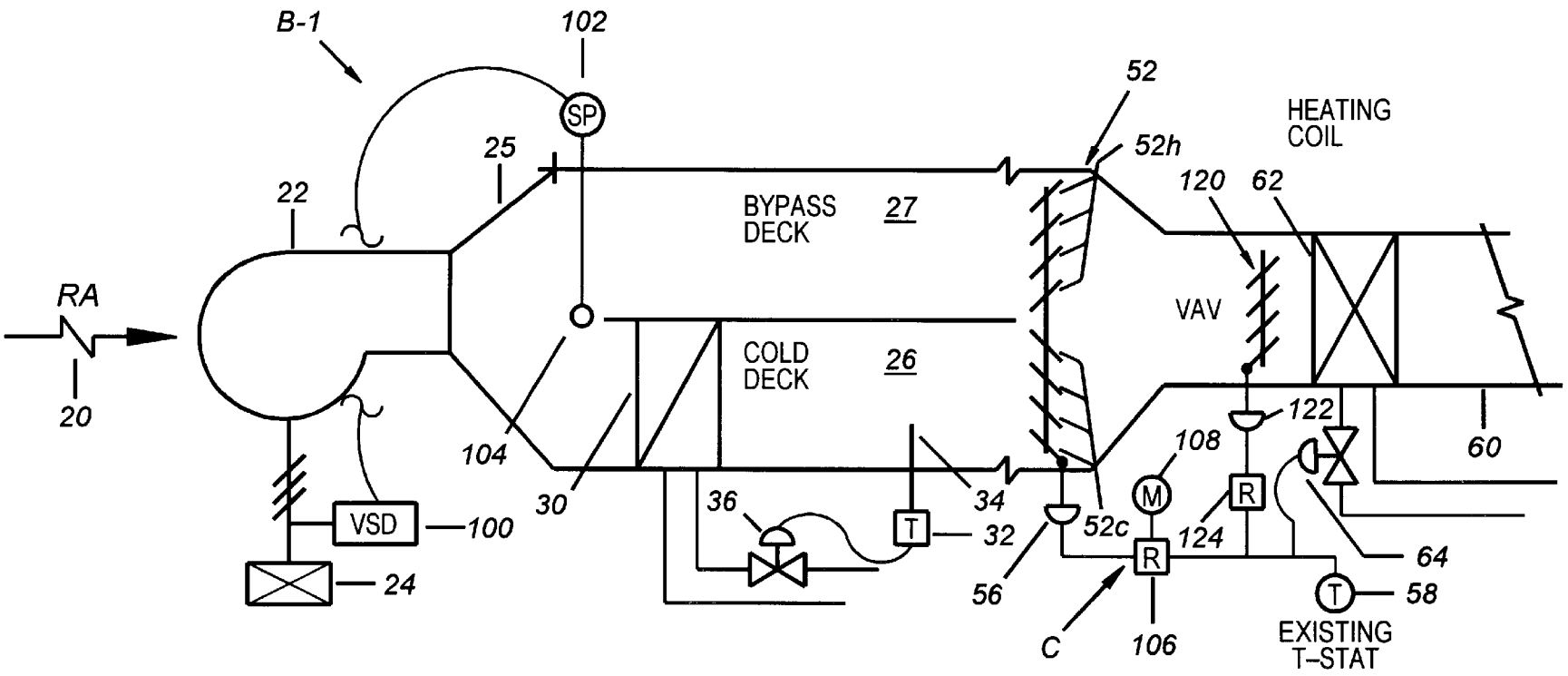
FIG. 7 is a schematic of a bypass or Texas multizone unit after conversion to a variable volume unit according to the present invention.

In FIG. 7, a modified bypass multizone unit B-1 having incorporated therein a control system C of the present invention is shown. In the bypass unit B-1, like structure to that of the bypass unit B bears like reference numerals. As was the case in the multizone unit M-1, the fan 22 is driven by a variable speed drive 100 whose speed is governed by the static pressure senor 102 based on readings taken at the inlet port 104 within the plenum 25. The control system C of bypass multizone unit B-1 includes the control relay 106 like that of the multizone unit M-1, as well as the flow control regulating vanes 120 governed by the damper motor 122 and control relay 124. These elements are of like construction to that of the multizone unit M-1 described above. As is the case with the multizone unit M-1, the performance characteristics of the bypass zone unit B-1 are comparable to those shown in FIG. 9 and operation of the bypass unit B-1 under influence of the control system C occurs in the same manner described above.

Figure 8:
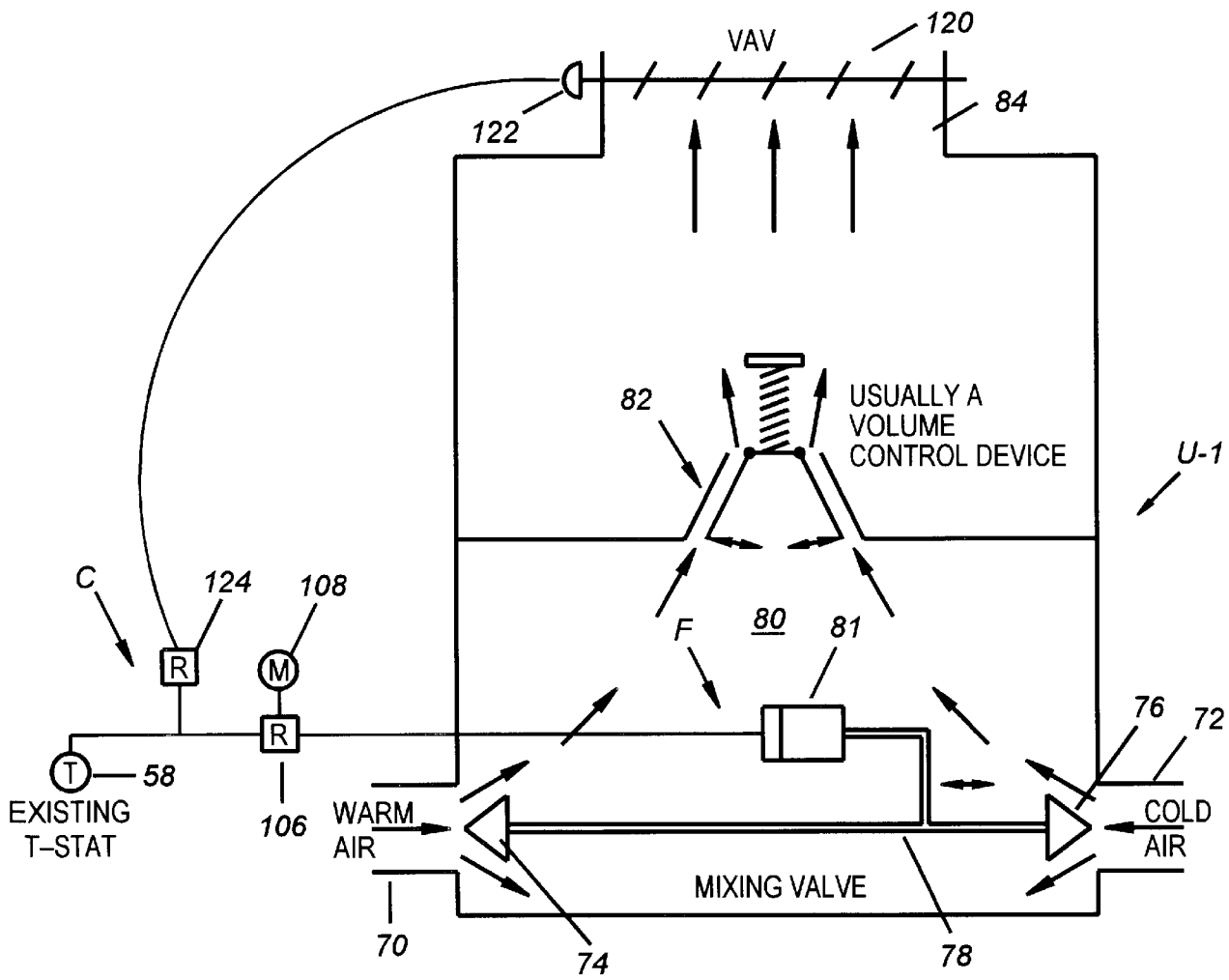
FIG. 8 is a schematic of a double duct box or terminal after conversion to a variable volume terminal according to the present invention.

Turning to FIG. 8 of the drawings, a mixing box U-1 for use with a double duct system like that shown in FIG. 3 of the drawings is shown. The mixing box U-1 is modified by incorporation therein of the control system C as shown in FIGS. 6 and 7 of the drawings.

Accordingly, like structure to that shown in other figures of the drawings bears like reference numerals where like functions are performed. In the mixing box U-1, the flow regulating vanes or variable air valve unit 120, controlled by the damper motor 122 and control relay 124, is located in the outlet ducting 84 from the mixing box U-1. The control relay 106 controls the position of the damper 74 and 76 of the mixing box U-1 based on the temperature conditions sensed by the thermostat 58 in accordance with the performance chart of FIG. 9 described above. Damper 74 is fully closed below threshold 110, while damper 76 is fully open. When the temperature sensed by thermostat 58 is above threshold 110, damper 76 is fully closed and damper 74 is fully open. Again, the variable air vanes 120 control the volume of air leaving the mixing box U-1, whether heated or cooled, as controlled by the relay 106, and allow the fan 22 to operate at reduced or increased speed, based on the need for volumes of air to maintain the desired temperature conditions in the zone being serviced by the thermostat 58.

Figure 10:
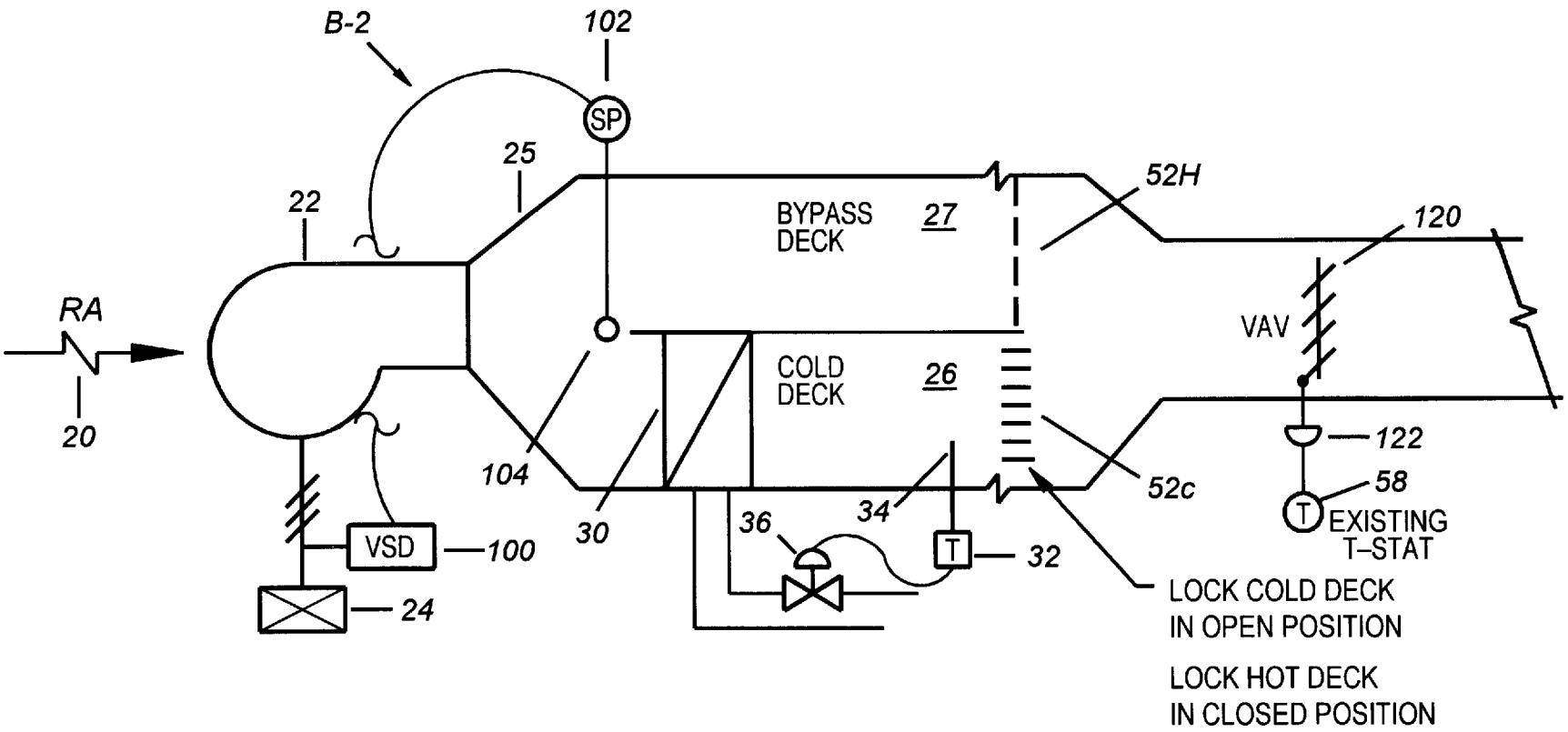
FIG. 10 is a schematic diagram of a multizone unit zone where heating is not required after conversion according to the present invention.

In FIG. 10 of the drawings, a standard or modified bypass multizone unit B-2 according to the present invention is shown. In the unit B-2, like structure to that of the units M-1 and B-1 bear like reference numerals. The multizone unit B-2 is used in situations where there is no need for heating. In such situations, the vanes 52*h* for the hot or bypass zone are locked in the fully closed position, as indicated in FIG. 10, while the vanes 52*c* for the cold deck zone 26 are lock in the fully open position. The thermostat 58 in the zone being serviced adjusts the volume of air flowing from the treating unit through the damper motor 122, again reducing energy demand by the fan 22 based on temperature conditions sensed by the thermostat 58.

Figure 11:
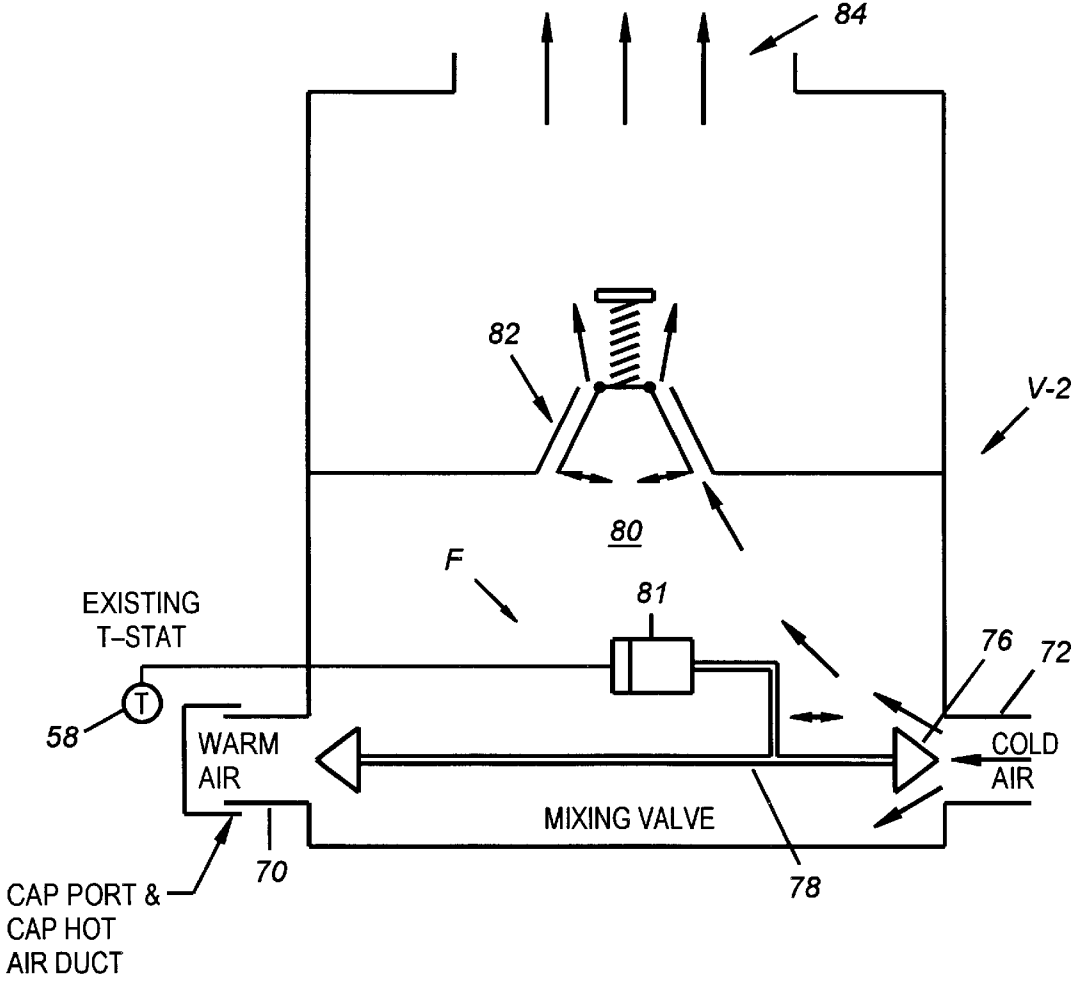
FIG. 11 is a schematic of a double duct box or terminal where heat is not required after conversion according of the present invention.

Finally, FIG. 11 of the drawings shows a modified mixing box U-2 used in conditions where no heated air is needed. In such a situation, the warm air duct 70 is capped or sealed, while the position of the cold air damper 76 in the cold air duct 72 is governed by the damper motor 81 based on temperature conditions sensed by the thermostat 58. Again, the relative amount of cold air flowing from the cold air duct 72 based on the temperature conditions sensed by the thermostat 58 govern the volume of air flowing through the mixing box U-2 and thus control the operating speed of the fan 22.

Having described the invention above, various modifications of the techniques, procedures, material and equipment will be apparent to those in the art. It is intended that all such variations within the scope and spirit of the appended claims be embraced thereby.

What is claimed is:

1. An air handling system with reduced energy consumption, comprising:

a thermostat for detecting air conditions in a zone;

a fan for moving air to the zone;

an air treating unit for imparting required characteristics to the moving air based on conditions sensed by said thermostat;

an air flow regulator for controlling the volume of moving air based on conditions sensed by said thermostat;

a pressure sensor for sensing the pressure of air at said air treating unit; and a fan speed controller responsive to said pressure sensor for reducing fan speed as the pressure of air at said treating unit increases to reduce energy consumption by said fan.

2. The air handling system of claim 1, wherein:

said air flow regulator reduces the volume of moving air as conditions sensed by said thermostat indicate reduced demand for treated air.

3. The air handling system of claim 1, wherein:

said air treating unit comprises a cold deck for cooling the moving air.

4. The air handling system of claim 1, wherein:

said air treating unit comprises a hot deck for heating the moving air.

5. The air handling system of claim 1, further including:

flow regulating vanes at an outlet of said treating unit for mixing the air leaving said treating unit.

6. The air handling system of claim 1, wherein:

said air treating unit comprises a cold deck for cooling the moving air, and a hot deck for heating the moving air; and further including:

flow regulating vanes at an outlet of said treating unit for mixing the heated and cooled air leaving said treating unit.

7. The air handling system of claim 6, further including:

a motor responsive to said thermostat for moving said flow regulating vanes.

8. The air handling system of claim 7, wherein said flow regulating vanes include:

hot deck vanes for controlling the amount of heated air leaving said hot deck;

cold deck vanes for controlling the amount of cooled air leaving said cold deck; and further including:

a motor control for opening said hot deck vanes and closing said cold deck vanes when said thermostat detects air temperature below a threshold temperature;

said motor control further opening said cold deck vanes and closing said hot deck vanes when said thermostat detects air temperature above the threshold temperature.

9. The air handling system of claim 1, wherein said air treating unit comprises a cold deck for cooling the moving air and a bypass section for passing a portion of the moving air; and further including:

flow regulating vanes at an outlet of said treating unit for mixing the cooled air and the air leaving said bypass sections; and an air heating zone for heating the controlled volume of air moving from said air flow regulator based on air conditions sensed by said thermostat.

10. The air handling system of claim 9, wherein said flow regulating vanes include:

vanes for controlling the amount of air leaving said bypass section;

cold deck vanes for controlling the amount of cooled air leaving said cold deck; and further including:

a motor control for opening said vanes of said bypass section and closing said cold deck vanes when said thermostat detects air temperature below a threshold temperature;

said motor control further opening said cold deck vanes and closing said vanes of said bypass section when said thermostat detects air temperature above the threshold temperature.

11. The air handling system of claim 1, wherein:

said air treating unit comprises a cold deck for cooling the moving air;

said air treating unit comprises a hot deck for cooling the moving air;

a mixing box for mixing the heated and cooled air.

12. The air handling system of claim 11, including:

a hot air duct for conveying heated air to the zone;

a cool air duct for conveying cooled air to the zone; and said mixing box receiving the heated air from said hot air duct and the cooled air from said cool air duct and mixing the heated and cooled air together.

13. The air handling system of claim 1, wherein:

said air treating unit comprises a cold deck for cooling the moving air; and a valve for regulating the volume of cooled air entering the zone based on conditions sensed by said thermostat.

14. The air handling system of claim 1, wherein the air conditioning/heating system includes an air treating unit for selectively heating and cooling air and flow regulating vanes for mixing air leaving said treating unit, and further including:

a motor responsive to said thermostat for moving said flow regulating vanes.

15. The air handling system of claim 14, further including:

a motor control for selectively opening and closing said flow regulating vanes based on air conditions detected by said thermostat.

16. A control system for an air conditioning/heating system for reducing energy consumption, comprising:

a thermostat for detecting air conditions in a zone;

a fan for moving air to the zone;

an air treating unit for imparting required characteristics to the moving air based on conditions sensed by said thermostat;

an air flow regulator for controlling the volume of moving air based on conditions sensed by said thermostat;

a pressure sensor for sensing the pressure of air at said air treating unit; and a fan speed controller responsive to said pressure sensor for reducing fan speed as the pressure of air at said treating unit increases to reduce energy consumption by said fan.

17. The control system of claim 16, wherein:

said air flow regulator reduces the volume of moving air as conditions sensed by said thermostat indicate reduced demand for treated air.

18. The control system of claim 16, further including:

a control system for adjusting said air flow regulator based on air conditions detected by said thermostat.

19. The control system of claim 16, wherein the air conditioning/heating system includes an air treating unit for selectively heating and cooling air and flow regulating vanes for mixing air leaving said treating unit, and further including:

a motor responsive to said thermostat for moving said flow regulating vanes.

20. The control system of claim 16, further including:

a motor control for selectively opening and closing said flow regulating vanes based on air conditions detected by said thermostat.

* * * * *